US007717523B2

(12) United States Patent
Weaver

(10) Patent No.: US 7,717,523 B2
(45) **Date of Patent: *May 18, 2010**

(54) ROTARY CUTTING PICK

(75) Inventor: Steven Weaver, Fletcher (AU)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 12/232,493

(22) Filed: Sep. 18, 2008

(65) Prior Publication Data

US 2009/0026829 A1 Jan. 29, 2009

Related U.S. Application Data

(62) Division of application No. 11/504,776, filed on Aug. 16, 2006.

(30) Foreign Application Priority Data

Aug. 22, 2005 (AU) ..... 2005-203762

(51) Int. Cl.
*E21C 35/183* (2006.01)

(52) U.S. Cl. ..... 299/111; 299/104

(58) Field of Classification Search ..... 299/100–113
See application file for complete search history.

(56) References Cited

U.S. PATENT DOCUMENTS

| | | | |
|---|---|---|---|
| 4,725,098 | A | 2/1988 | Beach |
| 5,823,632 | A | 10/1998 | Burkett |
| 6,113,195 | A | 9/2000 | Mercier et al. |
| 6,196,636 | B1 | 3/2001 | Mills et al. |
| 6,709,065 | B2 | 3/2004 | Peay et al. |
| 2003/0052530 | A1 | 3/2003 | Sollami |
| 2003/0122414 | A1 | 7/2003 | Sollami |
| 2003/0193235 | A1 | 10/2003 | Sollami |
| 2005/0212345 | A1 | 9/2005 | Sleep et al. |

FOREIGN PATENT DOCUMENTS

| | | |
|---|---|---|
| DE | 42 26 976 | 2/1993 |

*Primary Examiner*—Sunil Singh
(74) *Attorney, Agent, or Firm*—Drinker Biddle & Reath LLP

(57) ABSTRACT

A cutting pick comprises an elongate shank and a cutting tip mounted to one end of the shank. The cutting tip has a leading end, a trailing end and a mounting portion for mounting to the shank. The tip has a shape such that it diverges outwardly in a direction from the leading end to the trailing end to a portion of maximum diameter. An annular sleeve is attached about the shank adjacent to and in non-contacting relationship with the trailing end of the cutting tip. The maximum diameter of the cutting tip is of greater diameter than the diameter of the inner diameter of the annular sleeve so that the portion of maximum diameter overlies the sleeve radially.

24 Claims, 1 Drawing Sheet

ROTARY CUTTING PICK

This is a Divisional of copending application Ser. No. 11/504,776, filed Aug. 16, 2006, which claims priority to Australian Application No. 2005-203762 filed Aug. 22, 2005.

FIELD OF THE INVENTION

The present invention relates to cutting tools used for mining and excavation purposes. More particularly, the present invention relates to cutting tools for use in the mining of coal and in that use, typically underground coal mining.

BACKGROUND

Various different forms of equipment and machinery can be employed for mining and excavation operations, and typically it is the type of mining or excavation taking place, and the type of earth being mined or excavated, that dictates the type of equipment and machinery that is appropriate. The present invention is principally concerned with underground coal mining and with safety and maintenance issues relating to that form of mining. In relation to safety issues, one of the major safety difficulties in underground coal mining relates to fires or explosions that occur within the mine. These can occur due to the generation during mining of methane gas and coal dust (commonly known as mine dust), which can be trapped within the mine and is readily ignitable. Disadvantageously, the equipment used in coal mining can generate incendiary sparks and thus can cause fires or explosion. Therefore, it is important that all appropriate steps be taken to minimize or eliminate the production of sparks.

Equipment used to mine or excavate in hard earth, such as coal faces, can include rotary cutters, in which a rotating drum that carries a plurality of projecting cutting bits or picks, is brought into engagement with an earth face. The picks bite into the earth face as they rotate with the drum, to impact against and to dislodge or fragment earth from the face. This highly aggressive engagement between the picks and the earth face can result in spark production between them.

Cutting picks employed for coal mining generally have a hard cemented tungsten carbide tip that is fixed, usually by brazing, to a steel shank. Picks of this kind are disclosed in various prior art, such as U.S. Pat. No. 6,113,195, U.S. Pat. No. 4,725,098 and DE4226976. The tip of the picks can be either of the insert or cap style.

The insert style is shown in DE4226976, in which a greater section of the axial length of the tip is anchored within a bore of the shank, than extends out of the bore. The cap style is shown in U.S. Pat. No. 4,725,098, in which the tip has a broader base than the insert style tip and the base is located and brazed into a relatively shallow recess in the forward end of the shank. The present invention is applicable to cap style picks.

In picks of the above kind, sparks can be produced between the tungsten carbide tip and the earth face and also between the steel shank and the earth face, although there typically is greater likelihood of spark production between the steel shank and the earth face.

The highly aggressive environment in which the picks operate also results in wear of parts of the pick that come into contact with the earth being mined. Typically the shank of a pick is formed of a material that is softer than the tip of the pick and therefore the shank is more likely to be subject to wear than the tip and this is particularly the case closer to the tip.

An annular sleeve, attached to the shank of the cutting pick adjacent the cutting tip has been proposed for spark reduction, see for example in Applicant's U.S. Patent Publication No. 2005/0212345. The present invention relates to a similar form of cutting pick, but provides an arrangement to reduce the incidence of engagement of the sleeve with the earth face and/or with earth fragments dislodged during mining, in order to prolong the life of the sleeve against failure.

SUMMARY

According to a first aspect, a cutting pick, comprises an elongate shank, a cutting tip mounted to one end of the shank to project from the one end. The cutting tip has a leading end, a trailing end and a mounting portion for mounting to the shank. The mounting portion is disposed adjacent the trailing end and opposite to the leading end. The tip has a shape such that it diverges outwardly in a direction from the leading end to the trailing end to a portion of maximum diameter. An annular sleeve has an inner diameter and is attached about the shank adjacent to and in non-contacting relationship with the trailing end of the cutting tip. The portion of maximum diameter of the cutting tip is of greater diameter than a diameter of the inner diameter of the annular sleeve so that the portion of maximum diameter overlies the sleeve radially.

According to a second aspect, a method of using a cutting pick for mining comprises providing a cutting pick having an elongate shank, a cutting tip mounted to one end of the shank to project from the one end, the cutting tip having a leading end, a trailing end and a mounting portion for mounting to the shank, the mounting portion being disposed adjacent the trailing end and opposite to the leading end, the tip having a shape such that it diverges outwardly in a direction from the leading end to the trailing end to a portion of maximum diameter, an annular sleeve having an inner diameter and being attached about the shank adjacent to and in non-contacting relationship with the trailing end of the cutting tip, wherein the portion of maximum diameter of the cutting tip is of greater diameter than a diameter of the inner diameter of the annular sleeve so that the portion of maximum diameter overlies the sleeve radially, and mining in gas and/or mine dust containing environments.

BRIEF DESCRIPTION OF THE DRAWINGS

For a better understanding of the invention and to show how it may be performed, embodiments thereof will now be described, by way of non-limiting example only, with reference to the accompanying drawings.

DETAILED DESCRIPTION OF THE PREFERRED EMBODIMENTS

Figure 1:
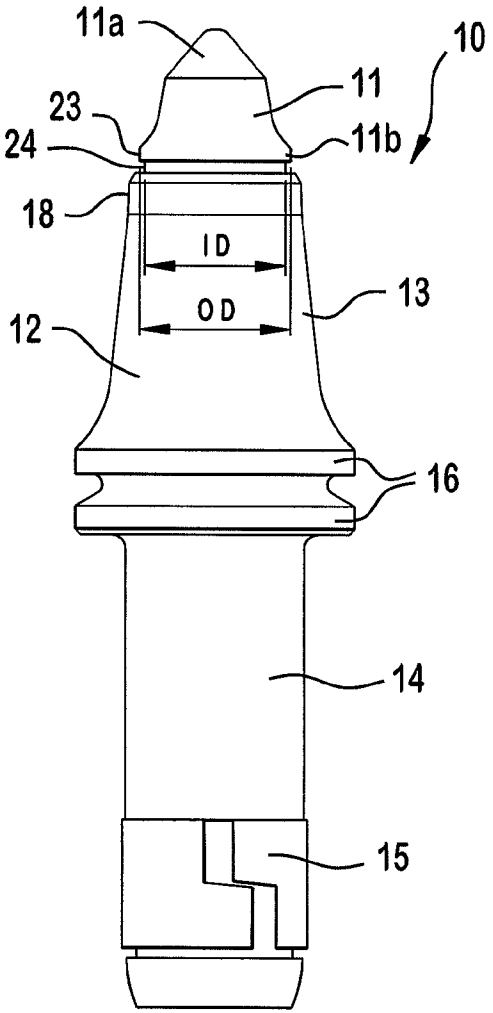
FIG. 1 is a side view of a cutting pick according to one embodiment of the invention.

FIG. 1 is a side view of a cutting pick 10 according to the present invention. The cutting pick 10 is used for mining and excavation purposes, and more particularly for mining of coal, typically underground coal mining. It will therefore be convenient to describe the invention in relation to that use although it will be readily appreciated that the invention could be employed for any mining or excavation operation to which its function is suitable.

The pick 10 includes a cutting tip 11 which has a leading end 11*a* and a trailing end 11*b* and which is mounted to an elongate shank 12. The shank 12 includes a conical section 13 and a cylindrical portion 14. The cylindrical portion 14 has connection mechanism 15 for connecting the pick 10 to a rotary cutting drum or the like while the tip 10 further includes a pair of flanges 16 which also contribute to mounting of the pick 10 in a rotary cutting drum. The manner in which the pick 10 is mounted in a rotary cutting drum does not form part of the invention and would be readily apparent to a person skilled in the art.

Figure 2:
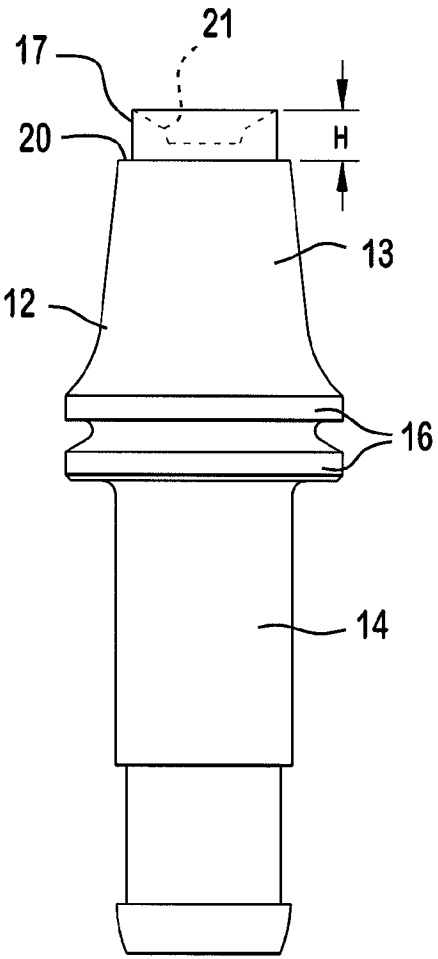
FIG. 2 is a side view of the shank of the cutting pick of FIG. 1.

The cutting pick 10 further includes a cylindrical section 17 (FIG. 2) and an annular sleeve 18 which extends about the cylindrical section 17 and is positioned adjacent to the trailing end 11*b* of the cutting tip 11. The annular sleeve 18 is arranged to be supported on the shoulder 20 which is defined between the conical section 13 and the cylindrical section 17.

Figure 4:
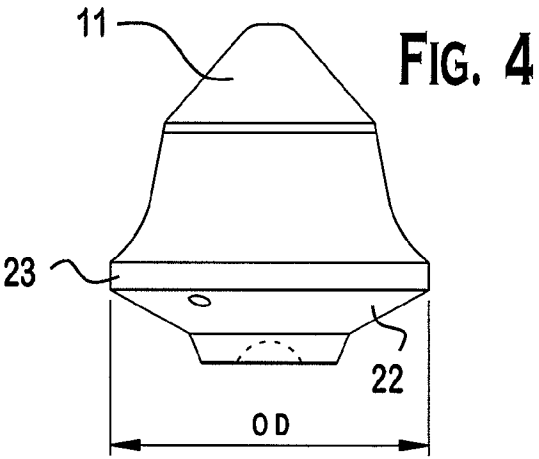
FIG. 4 is a side view of the cutting tip of the cutting pick of FIG. 1.

The cylindrical section 17 further defines a recess 21 (FIG. 2) which is arranged to accommodate a mounting portion 22 of the cutting tip 11 which is shown in FIG. 4. The mounting portion 22 can be fixed within the recess 21 in any suitable manner, such as by brazing.

Figure 3:
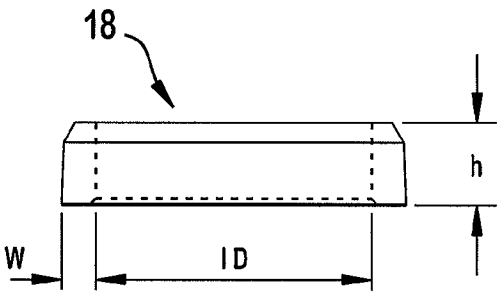
FIG. 3 is a side view of the annular sleeve of the cutting pick of FIG. 1.

FIGS. 3 and 4 identify the inside diameter "ID" of the annular sleeve 18 and the portion of maximum diameter "OD" of the cutting tip 11. According to the invention OD>ID. This arrangement is shown in FIG. 1.

The extent of the difference between the OD and the ID, is a matter of design, depending on the extent to which protection of the annular sleeve 18 is required. Protection is afforded by the portion 23 identified in each of FIGS. 1 and 4, radially overlying the sleeve 18. In prior art cutting picks, the ID is greater than the OD, so that the portion 23 does not overlie the sleeve and therefore the sleeve 18 is not protected to the same extent as the arrangement of the present invention. That lack of protection is acceptable in certain environments, and with sleeves made of certain materials but in other circumstances, such as a more aggressive mining environment, or when the sleeve is made of a particularly brittle material, greater protection is desirable.

The ratio between OD and ID can be greater or smaller than that shown in FIG. 1. Thus, the portion 23 can have a greater OD than that shown to further overlie the annular sleeve 18. Alternatively, the outside diameter of the sleeve 18 could be reduced, i.e. by reducing the wall thickness W (see FIG. 3), although that can reduce the strength of the annular sleeve 18 making it susceptible to fracture.

FIG. 1 shows that a portion of the cylindrical section 17 remains exposed in the preferred embodiment of the present invention. The exposed portion 24 is created by the height H of the cylindrical section 17 in the axial direction, being greater than the height h of the annular sleeve 18. By providing this gap, the annular sleeve 18 can be spaced axially away from the trailing end of the cutting tip 11 to a position in which it is more likely to be exposed to the impact of earth fragments. The portion 24 of the cylindrical section 17 is within the wear shadow of the cutting tip and therefore rarely experiences any fragment impact. It should be noted that the gap which is created to expose the portion 24 could be closed by extending the height h of the annular sleeve 18, although that increases the cost of the sleeve and increases the difficulty in its manufacture with certain desirable materials. Thus, the arrangement of FIG. 1 which includes the exposed portion 24 advantageously minimises the height h of the annular sleeve 18 without any major impact on the performance of the cutting pick 10.

The annular sleeve can be provided either for wear protection, or for spark protection or for a combination of both. If wear protection is required, then the sleeve can be of any suitable material, such as of the same material as the shank, or of a harder material. The sleeve can be of the same material as the cutting tip for example and in that arrangement, the sleeve could be formed from tungsten carbide.

The annular sleeve is attached about the shank adjacent to the trailing end of the cutting tip, as that is the position of the shank which is most likely to contact either the earth face being cut, or the earth fragments which have been dislodged from the face during cutting. Thus, it is that region of the shank which is most likely to wear and/or to generate an incendiary spark. The shank is less likely to come into contact with the earth face or earth fragments further away from the cutting tip, so that the provision of an annular sleeve is only required for a small portion of the shank adjacent the cutting tip, for either of wear and/or spark reduction.

If the sleeve is provided for spark protection, then the sleeve should be made of a material which has a lower propensity for incendive spark production during a cutting operation than the material of the shank. Again, the sleeve can be formed from the same material as the cutting tip if that material has the characteristics for spark resistance, and such a material could be tungsten carbide.

The annular sleeve can be formed as a circular ring for attachment to the shank, or it can be formed of sleeve segments which combine to form a ring. The sleeve can for example, be formed of semi-circular segments or "split rings". The use of split rings enables the sleeve to be attached to the shank in constructions of the shank which do not allow the sleeve, when formed as a closed ring, to be fitted to the shank.

In a cutting pick according to the invention, the elongate shank can take any suitable form, such as known forms, for fixing to a rotary cutting drum. The shank would usually be releasably fixable to the drum so that worn cutting picks can be replaced as necessary and in some machinery, the shank is rotatably mounted so that the cutting pick can freely rotate about its lengthwise axis as it engages an earth face. The shank usually would be manufactured from steel.

In a cutting pick according to the invention, the shank can be configured to receive a cap style cutting tip.

In a cutting pick according to the invention, the cutting tip can be manufactured from any suitable material preferably which is harder than the shank material, and the preferred cutting tip material is cemented tungsten carbide. The tip can also be diamond impregnated for increased hardness or can include cubic boron nitride for the same purpose. The cutting tip can have any suitable shape, which typically is dependent on whether the tip is of the insert or cap style. The cutting tip usually is brazed to the shank, although other arrangements for fixing the tip, such as by chemical adhesives, can be employed.

The sleeve which is attached about the shank adjacent the cutting tip preferably is formed from the same material as the cutting tip and preferably that material is a cemented tungsten carbide. Alternatively the material could be or include SiC, $Al_2O_3$, TiN, SiC-D (silicon carbide diamond composite), cubic boron nitride, tool steel, or other like materials. These materials can be formed as a composite material with other suitable materials, or they may be provided as an outer layer or layers over a suitable base.

In the preferred form of the invention, the annular sleeve is a single sleeve. Preferably, the axial height of the annular sleeve is between 4 mm and 20 mm. More preferably, the axial height of the annular sleeve is between 6 mm and 12 mm. Most preferably, the axial height of the annular sleeve is about 8 mm.

The radial wall thickness of the sleeve between inner and outer walls is between 1 mm and 6 mm. More preferably, the wall thickness of the annular sleeve is between 2 mm and 4 mm. Alternatively, the sleeve can be produced as a composite sleeve formed of a plurality of annular sleeve portions. For example, the annular sleeve could be formed of two or three annular sleeve portions.

In the preferred embodiment, the shank of the cutting pick includes a shoulder adjacent the tip of the pick which extends substantially perpendicular to the lengthwise axis of the shank between a generally conical section and a generally cylindrical section of the shank. The conical section converges towards the cylindrical section and the cylindrical section at one axial end thereof, defines a recess for receipt of the mounting portion of the cutting tip. In this arrangement, the annular sleeve is attached to the shank about the cylindrical section and one end is supported on the shoulder.

In the preferred arrangement, the axial height of the cylindrical section of the shank is greater than the axial height of the annular sleeve, so that a portion of the cylindrical section remains exposed. This arrangement is provided to reduce the likelihood of the annular sleeve fracturing during a cutting operation. Preferably the exposed portion of the cylindrical section is in the region of 1 mm to 5 mm axially, most preferably about 3 mm. This arrangement provides a gap between an upper axial end of the annular sleeve and the cutting tip. By this gap, the annular sleeve is spaced further away from the cutting tip and is less likely to be exposed to the earth face being cut and to earth fragments which have been dislodged. Moreover, because the gap is located close to the cutting tip and only a small portion of the cylindrical section is exposed, the likelihood of the exposed section engaging the earth face or earth fragments during the cutting operation is very low. That is, the exposed section is likely to be within the "wear shadow" of the cutting tip which is a section of the cutting pick that suffers negligible wear due to its close proximity to the cutting tip. Moreover, by spacing the annular sleeve away from the wear shadow, the sleeve can be positioned in a section of the pick that is more likely to experience impact engagements that would likely cause wear of the shank or incendiary spark production.

It is preferred that the cutting tip be mounted to the shank by brazing. However, other forms of connection could be employed.

In the preferred arrangement, the portion of maximum diameter of the cutting tip has a dimension of between 16 mm and 35 mm. More preferably, that diameter is between 24 mm and 29 mm.

Preferably, the inner diameter of the annular sleeve is between 14 mm and 34 mm. More preferably, the inner diameter of the annular sleeve is between 22 mm and 27 mm.

A cutting pick according to the invention advantageously can reduce the exposure of the annular sleeve to engagement with the earth face being mined or excavated, or with fragments of earth which have been dislodged by the pick. This is because by having the portion of maximum diameter of the cutting tip a diameter greater than the inner diameter of the annular sleeve, that portion can at least partly overlie the sleeve radially and therefore can deflect earth fragments away from engagement with the sleeve. In prior art cutting picks, the maximum diameter of the cutting tip is less than the inner diameter of the sleeve, so that the cutting tip provides no overlying protection to the sleeve by engagement with the earth face, or with earth fragments dislodged by the pick. Such an arrangement is acceptable in some mining or excavation environments, but in more aggressive environments, protection of the annular sleeve is desirable, to reduce the likelihood of its fracture. Even though the sleeve is protected in this manner, it can still adequately perform its primary function of wear and/or spark reduction, but with less likelihood of failure.

Accordingly, the sleeve can provide either or both of wear protection and spark protection, depending on the sleeve construction, more reliably through the life of the cutting pick.

The invention described herein is susceptible to variations, modifications and/or additions other than those specifically described and it is to be understood that the invention includes all such variations, modifications and/or additions which fall within the spirit and scope of the above description.

The invention claimed is:

1. A cutting pick, comprising:

an elongate shank;

a cutting tip mounted to one end of the shank to project from said one end, the cutting tip having a leading end, a trailing end and a mounting portion for mounting to the shank, the mounting portion being disposed adjacent said trailing end and opposite to the leading end, the tip having a shape such that it diverges outwardly in a direction from the leading end to the trailing end to a portion of maximum diameter;

an annular sleeve having an inner diameter and being attached about the shank adjacent to and in non-contacting relationship with the trailing end of the cutting tip, wherein the portion of maximum diameter of the cutting tip is of greater diameter than a diameter of the inner diameter of the annular sleeve;

wherein the shank defines a shoulder which extends perpendicular to a lengthwise axis of the shank between a generally conical section and a cylindrical section, the conical section converging towards the cylindrical section, the annular sleeve being attached to the shank about the cylindrical section and being supported on the shoulder; and wherein a height of the cylindrical section in the axial direction is greater than a height of the annular sleeve.

2. The cutting pick according to claim 1, wherein the annular sleeve is a wear ring.

3. The cutting pick according to claim 1, wherein the annular sleeve has a lower propensity for incendive spark production during a cutting operation than the shank.

4. The cutting pick according to claim 1, wherein the annular sleeve is a composite sleeve formed of a plurality of annular sleeve portions.

5. The cutting pick according to claim 4, wherein each annular sleeve portion has the same internal diameter.

6. The cutting pick according to claim 1, wherein the annular sleeve is formed of two or more sleeve segments.

7. The cutting pick according to claim 1, wherein the annular sleeve is a split ring.

8. The cutting pick according to claim 1, wherein an axial height of the cylindrical section is greater than an axial height of the annular sleeve, so that a portion of the cylindrical section remains exposed.

9. The cutting pick according to claim 1, wherein the portion of maximum diameter has a dimension of between 16 mm and 35 mm.

10. The cutting pick according to claim 1, wherein the portion of maximum diameter has a dimension of between 24 mm and 29 mm.

11. The cutting pick according to claim 1, wherein the inner diameter of the annular sleeve is between 14 mm and 34 mm.

12. The cutting pick according to claim 1, wherein the inner diameter of the annular sleeve is between 22 mm and 27 mm.

13. The cutting pick according to claim 1, wherein a wall thickness of the annular sleeve between radially inner and outer surfaces thereof, is between 1 mm and 6 mm.

14. The cutting pick according to claim 1, wherein a wall thickness of the annular sleeve between radially inner and outer surfaces thereof, is between 2 mm and 4 mm.

15. The cutting pick according to claim 1, wherein an axial height of the annular sleeve is between 4 mm and 20 mm.

16. The cutting pick according to claim 15, wherein an axial height of the annular sleeve is between 6 mm and 12 mm.

17. The cuffing pick according to claim 1, wherein an axial height of the annular sleeve is about 8 mm.

18. The cutting pick according to claim 1, wherein the annular sleeve has opposite axial ends, the end which is positioned closest to the trailing end of the cutting tip being bevelled.

19. A method of using a cuffing pick for mining, comprising:

providing a cutting pick having an elongate shank, a cutting tip mounted to one end of the shank to project from said one end, the cutting tip having a leading end, a trailing end and a mounting portion for mounting to the shank, the mounting portion being disposed adjacent said trailing end and opposite to the leading end, the tip having a shape such that it diverges outwardly in a direction from the leading end to the trailing end to a portion of maximum diameter, an annular sleeve having an inner diameter and being attached about the shank adjacent to and in non-contacting relationship with the trailing end of the cutting tip, wherein the portion of maximum diameter of the cutting tip is of greater diameter than a diameter of the inner diameter of the annular sleeve so that the portion of maximum diameter overlies the sleeve radially, wherein the shank defines a shoulder which extends perpendicular to a lengthwise axis of the shank between a generally conical section and a cylindrical section, the conical section converging towards the cylindrical section, the annular sleeve being attached to the shank about the cylindrical section and being supported on the shoulder, and wherein a height of the cylindrical section in the axial direction is greater than a height of the annular sleeve;

mining in gas and/or mine dust containing environments.

20. The method of claim 19, wherein the environment includes methane gas.

21. The method of claim 19, wherein the annular sleeve is formed of two or more sleeve segments.

22. The method of claim 19, wherein the annular sleeve is a split ring.

23. A cuffing pick, comprising:

an elongate shank;

a cutting tip mounted to one end of the shank to project from said one end, the cuffing tip having a leading end, a trailing end and a mounting portion for mounting to the shank, the mounting portion being disposed adjacent said trailing end and opposite to the leading end, the tip having a shape such that it diverges outwardly in a direction from the leading end to the trailing end to a portion of maximum diameter;

an annular sleeve having an inner diameter and being attached about the shank adjacent to and in non-contacting relationship with the trailing end of the cutting tip, wherein the annular sleeve is a split ring, wherein the portion of maximum diameter of the cuffing tip is of greater diameter than a diameter of the inner diameter of the annular sleeve;

wherein the shank defines a shoulder which extends perpendicular to a lengthwise axis of the shank between a generally conical section and a cylindrical section, the conical section converging towards the cylindrical section, the annular sleeve being attached to the shank about the cylindrical section and being supported on the shoulder; and wherein a height of the cylindrical section in the axial direction is greater than a height of the annular sleeve.

24. The cutting pick according to claim 23, wherein the annular sleeve is formed of two or more sleeve segments.

* * * * *